US005760532A

United States Patent [19]

Makoto et al.

[11] Patent Number: 5,760,532

[45] Date of Patent: Jun. 2, 1998

[54] SINTERED CERAMIC BODY FOR A SPARK PLUG

[75] Inventors: Sugimoto Makoto; Mamoru Musasa; Hiroyuki Tanabe, all of Mizuho-ku; Masahiro Konishi, Naoya, all of Japan

[73] Assignee: NGK Spark Plug Co., Ltd., Nagoya, Japan

[21] Appl. No.: 538,243

[22] Filed: Oct. 3, 1995

Related U.S. Application Data

[63] Continuation-in-part of Ser. No. 166,081, Dec. 10, 1993, abandoned, which is a continuation-in-part of Ser. No. 813,814, Dec. 26, 1991, abandoned.

[51] Int. Cl.[6] ..... H01T 13/20

[52] U.S. Cl. ..... 313/130; 313/131 A; 313/143; 501/96; 501/98

[58] Field of Search ..... 313/118, 143, 313/130, 131 A; 501/96, 97, 98, 152, 153

[56] References Cited

U.S. PATENT DOCUMENTS

| | | | |
|---|---|---|---|
| 2,296,033 | 9/1942 | Heller et al. | 313/11.5 |
| 4,853,582 | 8/1989 | Sato et al. | 313/141 |
| 5,049,367 | 9/1991 | Nakano | 501/96 |
| 5,077,245 | 12/1991 | Miyahara | 501/96 |
| 5,198,394 | 3/1993 | Sugimoto et al. | 501/98 |
| 5,210,457 | 5/1993 | Oshima et al. | 313/11.5 |

FOREIGN PATENT DOCUMENTS 1010071 1/1986 Japan .

*Primary Examiner*—Nimeshkumar Patel
*Attorney, Agent, or Firm*—Donald S. Dowden

[57] ABSTRACT

In a spark plug insulator made of a sintered ceramic body, including aluminum nitride (AlN) or aluminum oxynitride (AlON) ceramic powder having an average grain size of 1.5 μm in which the oxygen content of the aluminum nitride or the aluminum oxynitride powder is less than 2 percent by weight. Magnesium (Mg) is also present in an amount in the range from 0.01 wt. % to 5.0 wt. % where the amount of the magnesium (Mg) is calculated by converting the magnesium (Mg) to its oxidized compound (MgO). Also included is a sintering additive present in an amount up to 10 wt. % selected from the group consisting of rare earth metal compounds in which the weight percentage of the sintering additive is calculated by converting the sintering additive to its oxidized compound. The rare earth metal compound is selected from the group of yttrium oxide ($Y_2O_3$) calcium oxide (CaO), barium oxide (BaO), strontium oxide (SrO), scandium oxide ($Sc_2O_2$), europium oxide ($Eu_2O_3$) and lanthanum oxide ($La_2O_3$).

1 Claim, 1 Drawing Sheet

SINTERED CERAMIC BODY FOR A SPARK PLUG

This application is a continuation-in-part of application Ser. No. 166,081 filed Dec. 10, 1993, now abandoned, which, in turn, is a continuation-in-part of application Ser. No. 813,814 filed Dec. 26, 1991, abandoned.

BACKGROUND OF THE INVENTION

This invention relates to a sintered ceramic body particularly suitable for use as a spark plug insulator and possessing excellent insulation properties at high ambient temperature and having good thermal conductivity.

In spark plug insulators for internal combustion engines, a nitride-based sintered ceramic body having good thermal conductivity has been employed. However, for a nitride-based sintered ceramic body employed as a spark plug insulator, electrical insulation decreases when exposed to high ambient temperature and dendritic crystals form treeing over the surface of the sintered ceramic body due to Joule's heat caused from corona discharge creeping over the surface of the sintered ceramic body upon application of high voltage thereto.

U.S. Pat. Nos. 2,296,033, 4,853,582 and 5,210,457 describe spark plug structures. These patents disclose a spark plug having an insulator body and generally the overall structure of a spark plug having an insulator body and suitable for use in a spark ignition combustion engine. The disclosures of these patents are herein incorporated and made part of this disclosure.

It is an object of the invention to provide a sintered ceramic body particularly suitable for use as a spark plug insulator and capable of maintaining excellent insulation properties at high ambient temperature, while ensuring good thermal conductivity, thus preventing generation of Joule's heat to avoid growth of the dendritic crystals treeing over the surface of the sintered ceramic body when high voltage is applied.

SUMMARY OF THE INVENTION

According to this invention there is provided a sintered ceramic body comprising nitride or oxinite-based ceramic powder, the grain size of which is 1.5 μm, with an oxygen content of less than 2 weight percent and magnesium (Mg) in an amount of which ranges from 0.1 wt. % to 5.0 wt. % inclusive wherein the amount of magnesium (Mg) is calculated by reducing the magnesium (Mg) to its oxidized form (MgO).

Further, the sintered ceramic body contains a sintering additive up to 10 weight percent selected from the group consisting of alkaline earth metals and rare-earth metals in which the weight percentage of the sintering additive is calculated by reducing the additive to its oxidized form. Addition of the magnesium (MgO) causes formation of grain boundaries among crystal lattices during the process in which the ceramic body is sintered. This significantly contributes to elevated temperature electrical insulation properties of the ceramic body.

When the sintered ceramic body is employed in a spark plug insulator, the high temperature insulation properties prevent corona discharge creeping over the surface of the sintered ceramic body, thus avoiding generation of Joule's heat to prevent growth of dendritic crystals treeing over the surface of the sintered ceramic body when high voltage is applied.

The magnesium (MgO) content is employed at less than 0.1 wt. % and has almost no affect on increasing the electrical insulation properties of the ceramic body at the high ambient temperature. Magnesia (MgO) in an amount exceeding 5.0 wt. % induces voids in the ceramic body when sintering the ceramic body, thus reducing the density of the ceramic body and thereby providing moisture absorbing properties.

Employing the sintering additive in an amount up to 10 weight percent leads to improved sintering properties of the sintered ceramic body. However, employing the sintering additive in an amount exceeding 10 weight percent causes significant impairment of the thermal conductivity intrinsically provided by the nitride-based ceramic body. Absence of sintering additive serves to reduce the sintering property and requires an increased amount of magnesia (MgO) to ensure sufficient insulation for the sintered ceramic body.

Accordingly, the sintered ceramic body of this invention provides for the manufacture of a spark plug which is capable of preventing growth of dendritic crystals treeing over the surface of the sintered ceramic body upon applying high voltage, thereby maintaining both heat-resistant and anti-fouling property.

These and other objects and advantages of the invention will be apparent upon reference to the following specification and drawings.

DETAILED DESCRIPTION OF THE INVENTION

Figure 1:
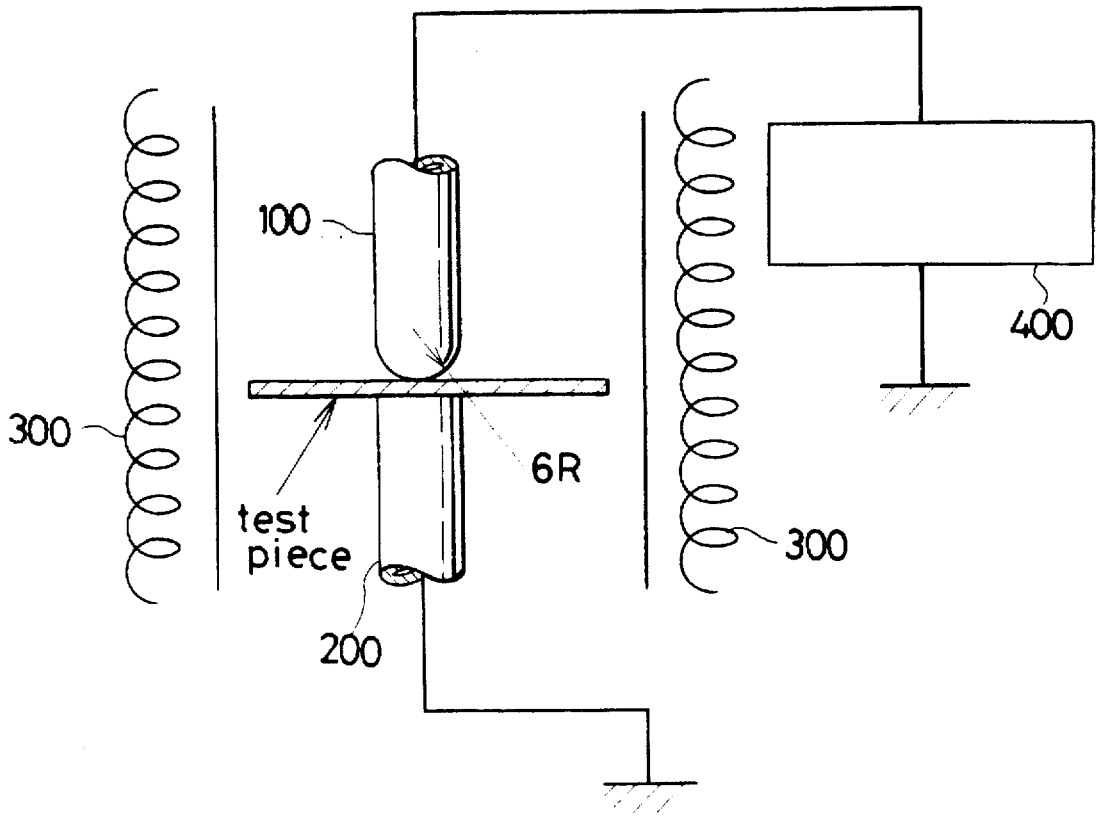
FIG. 1 is a schematic plan view showing a device used to measure high temperature electrical insulation of various test pieces.

Referring to FIG. 1 and accompanying Tables 1 and 2, aluminum nitride (AlN) powder is prepared as a nitride-based ceramic at a grain size measuring 1.5 μm in average (sedimentation analysis) with an oxygen content of 1.0 weight percent. It is mentioned that it is necessary to keep the oxygen content below 2.0 wt. % to maintain good sintering properties and good thermal conductivity.

The sintering additives were employed at 99.9% purity and are selected from the group consisting of yttrium oxide ($Y_2O_3$), calcium oxide (CaO), barium oxide (BaO), strontium oxide (SrO), scandium oxide ($SC_2O_3$), europium oxide ($Eu_2O_3$) and lanthanum ($La_2O_3$).

The test pieces (Nos. 1–15), see Table 1, of the sintered ceramic body according to this invention are manufactured as follows:

(1) A mixture of the sintering additive (except for test pieces Nos. 1–2), aluminum nitride (AlN powder, magnesia (MgO) and ethanol is kneaded overnight.

(2) After desiccating the mixture for degreasing the resulting mixture is pressed in a metallic die to form a compact plate measuring 50 mm in diameter and 3 mm in thickness for the purpose of measuring its electrical insulation.

(3) The compact plate is calcined about 500° C. for approximately 2 hours, and is pressed under the pressure of about 1.0 ton/cm$^2$ in a cold isostatic press (C.I.P.).

(4) The resulting compacted plate is then sintered at 1750°–1900° C. in nitrogen atmosphere for 2–5 hours as indicated in Table 1.

(5) The sintered compact plate is then lapped to measure 40 mm in diameter and 1 mm in thickness.

The test pieces (Nos. 16–28) listed in Table 2 are sintered in the manner as described above.

TABLE 1

| test piece No. | weight percent of AlN (wt %) | sintering additive | weight percent of sintering additive (wt %) | weight percent of MgO (wt %) | sintering conditions (°C. × Hrs) | relative density (%) | thermal conductivity (W/m · k) | electrical insulation at 700° C. (MΩ) |
|---|---|---|---|---|---|---|---|---|
| 1 | 97.00 | — | — | 3.00 | 1800 × 2 | 95.5 | 90 | 100 |
| 2 | 95.00 | — | — | 5.00 | 1850 × 5 | 96.5 | 76 | 150 |
| 3 | 97.50 | $Y_2O_3$ | 0.5 | 2.00 | 1900 × 2 | 98.0 | 96 | 180 |
| 4 | 96.50 | $Y_2O_3$ | 3.0 | 0.50 | 1900 × 2 | 99.0 | 160 | 600 |
| 5 | 93.99 | $Y_2O_3$ | 6.0 | 0.01 | 1800 × 2 | 99.5 | 145 | 90 |
| 6 | 89.00 | $Y_2O_3$ | 10.0 | 1.00 | 1700 × 2 | 99.5 | 105 | 300 |
| 7 | 96.75 | CaO | 3.0 | 0.25 | 1850 × 5 | 99.0 | 110 | 1500 |
| 8 | 94.95 | CaO | 5.0 | 0.05 | 1850 × 5 | 99.0 | 95 | 5000 |
| 9 | 95.50 | BaO | 3.0 | 1.50 | 1800 × 5 | 99.5 | 102 | 1000 |
| 10 | 97.20 | SrO | 2.0 | 0.80 | 1750 × 2 | 99.5 | 110 | 7500 |
| 11 | 93.50 | SrO | 4.0 | 2.50 | 1750 × 2 | 99.5 | 96 | 2500 |
| 12 | 87.50 | SrO | 8.0 | 4.50 | 1750 × 2 | 99.5 | 82 | 6000 |
| 13 | 95.80 | $Sc_2O_3$ | 3.0 | 1.20 | 1800 × 2 | 99.0 | 97 | 500 |
| 14 | 94.50 | $Eu_2O_3$ | 4.5 | 1.00 | 1800 × 2 | 98.5 | 127 | 150 |
| 15 | 91.00 | $La_2O_3$ | 8.0 | 1.00 | 1850 × 5 | 98.5 | 90 | 85 |

TABLE 2

| test piece No. | weight percent of AlN (wt %) | sintering additive | weight percent of sintering additive (wt %) | weight percent of MgO (wt %) | sintering conditions (°C. × Hrs) | relative density (%) | thermal conductivity (W/m · k) | electrical insulation at 700° C. (MΩ) |
|---|---|---|---|---|---|---|---|---|
| 16 | 97.00 | $Y_2O_3$ | 3.000 | — | 1800 × 2 | 99.5 | 160 | 5 |
| 17 | 94.00 | $Y_2O_3$ | 6.000 | — | 1750 × 5 | 99.0 | 155 | 3 |
| 18 | 95.00 | CaO | 5.000 | — | 1850 × 5 | 99.0 | 120 | 45 |
| 19 | 92.00 | SrO | 8.000 | — | 1750 × 2 | 99.5 | 105 | 25 |
| 20 | 97.00 | $Y_2O_3$ | 2.995 | 0.005 | 1750 × 2 | 99.5 | 155 | 40 |
| 21 | 97.00 | SrO | 2.998 | 0.002 | 1800 × 5 | 99.5 | 130 | 30 |
| 22 | 86.00 | $Y_2O_3$ | 12.000 | 2.000 | 1700 × 2 | 98.0 | 75 | 1500 |
| 23 | 83.00 | SrO | 15.000 | 2.000 | 1700 × 2 | 99.0 | 60 | 2000 |
| 24 | 80.00 | $Eu_2O_3$ | 18.000 | 2.000 | 1650 × 2 | 97.5 | 45 | 600 |
| 25 | 88.00 | $Y_2O_3$ | 5.000 | 7.000 | 1750 × 2 | 93.0 | 50 | 1050 |
| 26 | 85.00 | $Y_2O_3$ | 5.000 | 10.000 | 1750 × 2 | 90.0 | 35 | 2000 |
| 27 | 88.00 | SrO | 4.000 | 8.000 | 1650 × 2 | 92.0 | 35 | 4500 |
| 28 | 89.50 | CaO | 4.000 | 6.500 | 1700 × 2 | 91.0 | 45 | 6500 |

In Tables 1 and 2 the relative densities of test pieces (Nos. 1–28) are obtained as a ratio of apparent density-theoretical density by using the Archimedean method.

Referring now to FIG. 1, the device shown is used to measure the electrical insulation of the test pieces (Nos. 1–28) at 700° C.. The device has brass electrodes 100, 200, a coil heater 300 and a 500-volt digital resistance meter 400. For the measurement of thermal conductivity, a laster flash method is used. The amounts of magnesia (MgO) and the sintering additive are measured on the basis of fluorescent-sensitive X-ray detection.

Of the test pieces (Nos. 1–28), test pieces Nos. 1–2 are acceptable as a spark plug insulator, considering that the spark plug insulator needs thermal conductivity of more than 76 W/m.k from a heat-dissipating point of view and with electrical insulation of more than 50 MΩ at 700° C. from a treeing-prevention point of view while having or providing a relative density of more than 95% for curbing growth of dendritic crystal treeing.

It was found that test pieces Nos. 3–15 are better suited for a spark plug insulator from the point of view of maintaining desired sintering properties, relative density, thermal conductivity and electrical resistance.

Test pieces Nos. 16–19 contain no magnesia (MgO) so that each of their electrical insulation values is less than 50 MΩ at 700° C.. Test pieces Nos. 22–24 contain sintering additive exceeding 10 wt. % so that each of their thermal conductivity is less than 75 W/m.k. Test pieces Nos. 25–28 contain magnesia (MgO) in an amount more than 5 wt. % so that for each their relative density is less than 95%.

Spark plug insulators were made of test pieces Nos. 1–15 with an axial bore of the insulator, a center electrode, a resistor and a terminal electrode are placed through a conductive glass sealant. Then, the insulator was placed within a metallic shell to form a spark plug which was found to be capable of avoiding Joule's heat generation caused from corona discharge creeping over the surface of the insulator so as to prevent growth of dendritic crystals treeing over the surface of the insulator upon applying high voltage, thus maintaining both heat-resistant and anti-fouling property. The nitride-based ceramic included sialon (Trademark) and aluminum oxinite (AlON).

The sintering additives may be selected in an appropriate combination from the group consisting of yttrium oxide ($Y_2O_3$), calcium oxide (CaO), barium oxide (BaO), strontium oxide (SrO), scandium oxide ($SC_2O_3$), europium oxide ($Eu_2O_3$) and lanthanum oxide ($La_2O_3$), as long as an amount of the combination is up to 10 wt. %. It is further to be noted that the sintering additive may be an oxidized compound of a metal selected from the group consisting of neodymium (Nd), dysprosium (Dy) and cerium (Ce). It is also appreciated that the sintering additive may be a metallic compound selected from the group consisting of chloride, hydroxide, fluoride, carbide, sulfide, carbonate, nitrite, acetate or phosphate.

The following features define the subject invention and its distinctiveness over the prior art.

(1) Aluminum nitride (AlN) or aluminum oxide nitride (AlON) is employed as the basic ceramic powder of the sintered ceramic body.

(2) The average grain size of the aluminum nitride (AlN) or the aluminum oxynitride (AlON) is 1.5 μm.

(3) The oxygen content of the aluminum nitride or the aluminum oxynitride is less than 2 weight percentage (wt %).

(4) Magnesium (Mg) is employed in an amount in the range 0.01 wt. % to 5.0 wt. % inclusive wherein the amount the magnesium (Mg) is calculated by reducing the magnesium (Mg) to its oxidized compound (MgO).

(5) The spark plug insulator body has an electrical resistance of more than 50 MΩ at a temperature of 700° C..

The combination of the above features (1)–(5) provide a spark plug insulator of a ceramic sintered body which is capable of maintaining improved insulating properties in a high temperature environment while ensuring excellent thermal conductivity.

There is additionally in Table 3 the results of laboratory tests carried out to demonstrate the influence and effectiveness of particle size and the superiority of the special particle size in accordance with this invention, i.e. a sintered ceramic body having aluminum nitride AlN or aluminum oxynitride AlON having an average grain size of 1.5 μm.

TABLE 3

| AlN (AlON) powder sample | oxygen content wt. % | grain size Av micron m | sintering property | thermal conductivity W/m − k | resistance MΩ |
|---|---|---|---|---|---|
| A | 1.2 | 1.8 | good | 140 | 90 |
| B | 1.5 | 0.9 | good | 120 | 65 |
| C | 0.9 | 2.1 | not good | 75 | 50 |
| D | 1.0 | 2.9 | not good | 80 | 60 |
| E | 3.5 | 1.8 | good | 65 | 45 |
| F | 1.5 | 1.0 | good | 70 | 80 |
| G | 0.7 | 1.5 | good | 160 | 500 |
| H | 0.8 | 1.6 | good | 150 | 650 |
| I | 0.9 | 2.6 | not good | 80 | 90 |
| J | 0.7 | 1.6 | good | 155 | 450 |

The test results reported in Table 3 show critical significance with respect to a sintered ceramic body having an average grain size of 1.5 microns, the sintered ceramic body being comprised of AlN, AlON, in the amount 95 wt. %, with $Y_2O_3$ in the amount 4.9 wt. % and MgO in the amount 0.1 wt. %. The AlN powder employed in the tests of Table 1 was prepared by alumina deoxidation and nitrogenization. Additionally, in Table 3 the oxygen content and average grain size is reported. In the preparation of the sintered ceramic bodies the sintering conditions employed were 1700° C. for 2 hours in a nitrogen atmosphere.

Also, with respect to the test results reported in Table 3 it is mentioned that, as to the sintering properties, Samples C, D and I have a rather large grain size with the result that voids reside in the sintered body and worsen the sintering properties, indicating the desirability to decrease grain size.

Further, with respect to the thermal conductivity property of the sintered ceramic material, it is to be noted that:

In Samples C, D and I, the thermal conductivity decreases due to the residual voids in the sintered body. In Sample E, the thermal conductivity decreases due to the increased oxygen content in AlN (AlON) which produces aluminate yttrium in the sintered body. This leads to the desirability to limit oxygen content to less than 2.5 wt. %.

Finally, with respect to the reported insulating property, resistance Ω, it is to be noted that:

In Samples A≈F and I, insulating property (resistance MΩ) is low. In Samples C, D and I, the decreased resistance is apparently due to the residual voids. In Samples, A, B and F, the low resistance appears to be due to the grain size. The critical grain size is at an average grain size of 1.5 μm.

These noted additional test results demonstrate the special properties of a sintered ceramic body prepared in accordance with this invention.

It is particularly to be noted that experimental tests results of Table 3, particularly in Sample G, show that the average grain size (1.5 microns) of AlN (AlON) has advantageous significance over the prior art larger grain size, such as 1.8 microns. These data presented herein show that differences in grain size are significant and control of the grain size is not obvious. The results herein demonstrate unexpected results by using the invention' specific grain size in comparison with the prior art.

Specifically, comparative experimental tests were carried out to show the advantageous differences between the compositions of the subject invention and the teachings and materials of the prior art, such as Miyahara U.S. Pat. No. 5,077,245 (1991) and Japanese Patent Publication No. 1010071 (1986). These comparative tests carried out by applicants indicates that Miyahara's sintered aluminum nitride does not satisfy a value of 40 MΩ (insulation resistance) at 70° C. due to the absence of MgO therein, although Miyahara's relative density and thermal conductivity would appear to be satisfactory. However, because of Miyahara's deficiency with respect to insulation resistance, it is evident that in use treeing would readily and quickly occur when used as a insulator, thereby shortening its useful life and making it impractical for use as a spark plug insulator.

The aforementioned Japanese patent publication discloses aluminum nitride containing 3% $MgCO_3$. Due to the presence of 3% $MgCO_3$, this Japanese patent publication material provides the high temperature insulation resistance. However, the resulting finished material is deficient with respect to heat-resistivity since its thermal conductivity is as low as 60 W/mK. This means that despite improved heat resistivity, the Japanese patent publication material is not practical for use as a spark plug insulator.

The Examiner is referred to the accompanying tabulation, Table 4, which shows the results of additional comparative tests. Table 4, presents the results of tests carried out wherein test species a and b are the same as those described or disclosed in test pieces No. 3 and No. 19 in Table 1 of the Miyahara patent. Also test pieces Nos. c and d in the comparative tests, the results of which are listed in Table 4, are the same materials or compositions disclosed in Nos. 9 and 10 in Table 1 of the Japanese patent publication. Further, test pieces Nos. 5 and 7 in accompanying Table 4 are the same as those disclosed in the embodiments of Table 1 herein.

TABLE 4

{Data Obtained by Carrying Out Comparative Experimental Test}

| Test Piece No. | weight percent of ALN (wt %) | sintering additive | weight percent of sintering additive | weight percent of MgO (wt %) | sintering conditions (°C. × Hrs) | relative density (96) | thermal conductivity (W/mK) | electrical insulation at 700° C. (MΩ) |
|---|---|---|---|---|---|---|---|---|
| a | 92.0 | CaO<br>$Y_2O_3$ | 1.0<br>7.0 | — | 1860 × 2 | 99.8 | 116 | 15 |
| b | 94.5 | CaO<br>$Y_2O_3$ | 2.5<br>3.0 | — | 1860 × 2 | 98.0 | 121 | 25 |
| c | 97.0 | — | — | $MgCO_3$<br>3.0 | 1800 × 2 | 96.0 | 60 | 1500 |
| d | 97.0 | $CaCO_3$ | 3.0 | — | 1800 × 2 | 98.5 | 105 | 40 |
| 5 | 93.99 | $Y_2O_3$ | 6.0 | 0.01 | 1800 × 2 | 99.5 | 145 | 90 |
| 7 | 96.75 | CaO | 3.0 | 0.25 | 1850 × 5 | 99.0 | 110 | 1500 |

The data presented by applicants, see the Tables 1–4 show that control of particle size would not be obvious in the preparation of applicants' superior compositions. The important and critical significance of the data presented in Tables 1–4 show also that it is not obvious or routine to prepare the compositions of this invention having the displayed improved combination of physical properties, such as thermal conductivity, electrical resistance, density and strength.

While the invention has been described with reference to the specific embodiments, it is to be understood that the description of the invention herein is not to be construed in a limiting sense in as much as various modifications and additions to the specific embodiments of the invention may be made by those skilled in the art without departing from the spirit and scope of this invention.

What is claimed is:

1. A spark plug insulator for an internal combustion engine, said spark plug insulator being formed with a sintered ceramic body comprising:

aluminum nitride (AlN) or aluminum oxynitride (AlON) made from ceramic powder having an average grain size of about 1.5 μm, the oxygen content of said aluminum nitride or said aluminum oxynitride being less than 2% by weight, and magnesium (Mg) in an amount in the range from 0.01 wt. % to 5.0 wt. % inclusive, the amount of magnesium being calculated by converting the magnesium to its oxidized compound (MgO), and containing a sintering additive present in an amount of 10 wt. % of a rare earth metal compound selected from the group consisting of yttrium oxide $Y_2O_3$, scandium oxide, europium oxide ($Eu_2O_3$) and lanthanum oxide, the weight percentage of said sintering additive being calculated by converting the sintering additive to its oxide form;

said sintered ceramic body having an electrical resistance of more than 50 MΩ at a temperature of 700° C. and a thermal conductivity of at least 76 W/m k; and said sintered ceramic body further having relative density of at least 95%.

* * * * *